US007381085B2

(12) United States Patent
Lutsch et al.

(10) Patent No.: US 7,381,085 B2
(45) Date of Patent: Jun. 3, 2008

(54) CONNECTION ASSEMBLY

(75) Inventors: Harald Michael Lutsch, Ottrau (DE); Ranko Resman, Zagreb (HR); Josip Jelak, Krizevci (HR); Boris Fretze, Zagreb (HR)

(73) Assignee: Yazaki Europe Ltd., Hartfordshire (GB)

( * ) Notice: Subject to any disclaimer, the term of this patent is extended or adjusted under 35 U.S.C. 154(b) by 0 days.

(21) Appl. No.: 11/828,763

(22) Filed: Jul. 26, 2007

(65) Prior Publication Data

US 2008/0032545 A1 Feb. 7, 2008

(30) Foreign Application Priority Data

Aug. 2, 2006 (DE) ..... 10 2006 036 370

(51) Int. Cl.
*H01R 3/00* (2006.01)

(52) U.S. Cl. ..... 439/489; 439/352; 439/595

(58) Field of Classification Search ..... 439/489, 439/352, 595

See application file for complete search history.

(56) References Cited

U.S. PATENT DOCUMENTS

| | | | | |
|---|---|---|---|---|
| 6,347,952 | B1 | 2/2002 | Hasegawa et al. | |
| 6,361,347 | B1 * | 3/2002 | Murakami et al. | 439/352 |
| 6,743,051 | B2 * | 6/2004 | Hayashi | 439/620.05 |
| 7,033,207 | B2 | 4/2006 | Nimura | |
| 2003/0096527 | A1 | 5/2003 | Greiner | |

FOREIGN PATENT DOCUMENTS

| | | | |
|---|---|---|---|
| DE | 60001530 | T2 | 1/2004 |
| DE | 102004056966 | A1 | 7/2005 |
| DE | 10 2005 030 264 | A1 | 5/2006 |
| EP | 0 488 087 | A2 | 6/1992 |
| EP | 0 862 244 | A1 | 2/1998 |
| JP | 09063696 | A | 3/1997 |
| WO | WO 2006/053744 | A1 | 5/2006 |

* cited by examiner

*Primary Examiner*—Truc T Nguyen
(74) *Attorney, Agent, or Firm*—Sughrue Mion, PLLC

(57) ABSTRACT

A connection assembly having a first connector and a second connector which can be connected to or disconnected from one another by being adjusted along a longitudinal axis, wherein the first connector comprises a first housing which is provided with an elastically deformable locking arm comprising an end connected to the first housing and a free end, as well as a first stop; the second connector comprises a second housing which is provided with a second stop; the first stop and the second stop are designed in such a way that when the two connectors are being connected to one another, they cooperate in such a way that the elastic locking arm 6 temporarily experiences an elastic deformation and, that, after the connected position has been achieved, it experiences an elastic return movement; the second housing comprises a first tunnel portion with a tunnel axis, into which first tunnel portion the locking portion 6, in the connected condition of the two connectors, projects at least partially, which first tunnel portion, at least at one end, is open along the tunnel axis and in which there is arranged the second stop; and which first tunnel portion is associated with a freely oscillating tongue which comprises an end connected to the second housing and a oscillatory end, wherein the elastic return movement of the locking arm which is pretensioned when the first connector is being connected to the second connector, causes the tongue to oscillate, thus generating an airborne sound emerging from the first tunnel portion.

14 Claims, 6 Drawing Sheets

CONNECTION ASSEMBLY

BACKGROUND OF THE INVENTION

The invention relates to a connection assembly with a first connector and a second connector which, by being adjusted along a longitudinal axis, can be connected to one another or disconnected from one another in the opposite direction. The first connector comprises a first housing which is provided with an elastically deformable locking arm comprising a first stop. The second connector of said connection comprises a second housing which is provided with a second stop. The first stop and the second stop are designed in such a way that, when the two connectors are being connected to one another, the first stop and the second stop cooperate in such a way that the elastic locking arm temporarily experiences an elastic deformation and, when the final connected position has been achieved, it experiences an elastic return movement.

Such a connection is described in US 2003/0096527 A1 wherein there is additionally provided a slide which is used in order to determine whether the two connectors have been properly connected to one another. When said slide is moved, it is possible, through contact with the locking arm, to generate a signal which can be heard or sensed to indicate the correct connecting position.

SUMMARY OF THE INVENTION

It is the object of the present invention to propose a connection wherein, when the final connected position of the two connectors has been reached, there is generated a clearly audible sound which indicates that the correct connected position has been reached.

In accordance with the invention, the objective is achieved by proposing a connection assembly having a first connector and a second connector which can be connected to or disconnected from one another by being adjusted along a longitudinal axis, wherein

- the first connector comprises a first housing which is provided with an elastically deformable locking arm which comprises an end connected to the first housing and a free end, as well as a first stop;
- the second connector comprises a second housing which is provided with a second stop;
- the first stop and the second stop are designed in such a way that when the two connectors are being connected to one another, they cooperate in such a way that the elastic locking arm temporarily experiences an elastic deformation and, that, after the connected position has been achieved, it experiences an elastic return movement;
- the second housing comprises a first tunnel portion with a tunnel axis, into which first tunnel portion the locking portion projects at least partially in the connected condition of the two connectors, which first tunnel portion, at least at one end, is open along the tunnel axis and in which there is arranged the second stop; and which first tunnel portion is associated with a freely oscillating tongue which comprises an end connected to the second housing and a oscillatory end, wherein the elastic return movement of the locking arm which is pre-tensioned when the first connector is connected to the second connector causes the tongue to oscillate, thus generated an airborne sound emerging from the first tunnel portion.

However, said objective is also achieved by proposing a connection assembly having a first connector and a second connector which can be connected to or disconnected from one another by being adjusted along a longitudinal axis, wherein

- the first connector comprises a first housing which is provided with an elastically deformable locking arm which comprises an end connected to the first housing and a free end, as well as a first stop;
- the second connector comprises a second housing which is provided with a second stop;
- the first stop and the second stop are designed in such a way that when the two connectors are being connected to one another, they cooperate in such a way that the elastic locking arm temporarily experiences an elastic deformation and, that, after the connected position has been achieved, it experiences an elastic return;
- the second housing comprises a first tunnel portion with a tunnel axis, into which first tunnel portion the locking arm projects at least partially in the connected condition of the two connectors, which first tunnel portion, at least at one end, is open along the tunnel axis and which is de-limited via two side walls connected to a second base portion of the second housing and via a ceiling portion arranged opposite the second base portion and connecting the two side walls;
- wherein the first stop in the first tunnel portion is arranged at the ceiling portion and wherein the elastic return movement of the locking arm being pre-tensioned when the first connector is connected to the second connector, causes the ceiling portion to oscillate due to an abrupt application of load, thus generating an airborne sound emerging from the first tunnel portion.

Because there is provided a tunnel portion at the second connector, which tunnel portion is entered by the locking arm during the connecting process there is effectively produced a sound chamber, so that as a result of the excitation of the tongue and, respectively, of the ceiling portion of the first tunnel portion of the second housing, the exit of the airborne sound can be heard. In addition, the oscillation as generated can be clearly sensed by the engineer carrying out the connecting operation. The important aspect is that there is generated a sound which is above the sound level of the environment, more particularly during the assembly of vehicles, because in the production hall there exists a certain basic sound level which has to be exceeded.

This objective is achieved by the invention.

According to an embodiment of the first solution, the first tunnel portion is delimited by two side walls connected to a second base portion of the second housing and by a ceiling portion which is arranged opposite the second base portion and connects the two side walls. In a preferred embodiment, the at least one tongue is positioned between the ceiling portion and the second base portion. The sound chamber produced by the first tunnel portion can advantageously be used for generating a noise. Preferably, the freely oscillating tongue, by means of its connected end, is attached to the ceiling portion and is positioned in the first tunnel portion. It is possible for the ceiling portion, too, to be designed for oscillating purposes.

According to a preferred embodiment, the first stop is positioned in an opening of the locking arm, i.e. it is formed by the opening in the locking arm. The associated second stop is formed by a projection with a ramp face. The first stop extends substantially at a right angle relative to the longitudinal axis. It is advantageous for the locking arm to comprise an inclined abutment face which cooperates with the ramp face of the projection provided with the second stop, as a result of which the locking arm is gradually elastically pre-tensioned while the two connectors are being connected, i.e. by means of its free end, it approaches the longitudinal axis for example and can then snap back into its untensioned starting position as soon as the first stop pas passed the second stop, with the two stops being able to mutually support one another in such a way that disconnection against the connecting direction along the longitudinal axis is no longer possible, i.e. the first connector and the second connector are in the final and proper connected position.

It is advantageous for the second stop to be associated with the ceiling portion of the first tunnel portion. This means that the ceiling portion is loaded by the returning locking arm directly after the first stop has passed the second stop and thus has been made to oscillate, and in case there has been provided a freely oscillatory tongue, this, too, is incited. However, it is also possible for the second stop to be associated with the second base portion of the second housing.

The sound generated can be modulated, more particularly for the purpose of designing the tunnel portion and first ceiling portion as well as the side walls delimiting the first tunnel portion, and for dimensioning and shaping the tongue.

A further alternative for designing the freely oscillating tongue consists in providing the ceiling portion with cuts so that the connected end of the tongue is integral with the ceiling portion.

It is advantageous if the setting movement and the elastic deformation of the locking arm are such that when the second stop is associated with the ceiling portion of the first tunnel portion, the return movement of the locking arm leads to an abrupt application of load on the ceiling portion.

It is also advantageous if the first tunnel portion and/or the tongue are designed in such a way that the airborne sound is generated with a frequency of 1 kHz to 4 kHz.

An airborne sound with a frequency range of 2 kHz is particularly easily heard by a human ear.

According to a further embodiment, more particularly of the solution according to which the ceiling of the first tunnel portion is used to generate the airborne sound, it is advantageous if the first housing is associated with a second tunnel portion which, in the connected condition of the connector, at least partially covers the first tunnel portion. This makes it possible to design the first tunnel portion in the region of its cover portion in such a way that an airborne sound can be advantageously generated. For example, it is possible to provide recesses and slots. Such a measure can also be applied in connection with an embodiment wherein the freely oscillating tongue is formed by cuts in the ceiling portion of the first tunnel portion, because this allows a clearly audible sound to be generated.

According to a preferred embodiment, it is proposed that, in the connected position of the connectors, the second tunnel portion encloses the first tunnel portion in such a way that a ceiling of the second tunnel portion is positioned at a distance from the first ceiling portion of the first tunnel portion.

BRIEF DESCRIPTION OF THE DRAWINGS

Preferred embodiments of the invention are schematically illustrated in the drawing wherein.

DETAILED DESCRIPTION OF THE INVENTION

First, there will follow a description of the first embodiment of the two connectors 1, 2 with reference to FIGS. 1 to 5.

Figure 1:
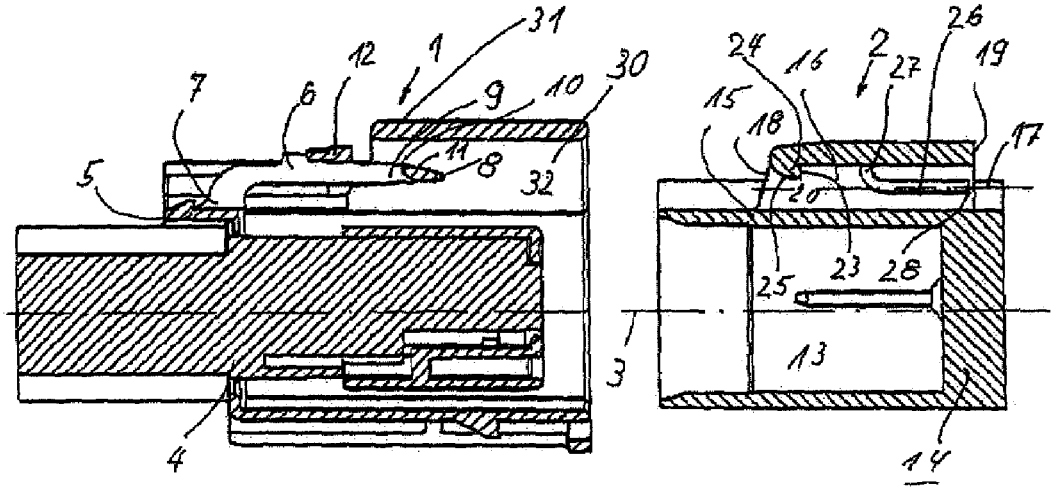
FIG. 1 shows a first embodiment of a first connector and of a second connector prior to being connected along a longitudinal axis on which they are jointly aligned for connecting purposes.
Figure 2:
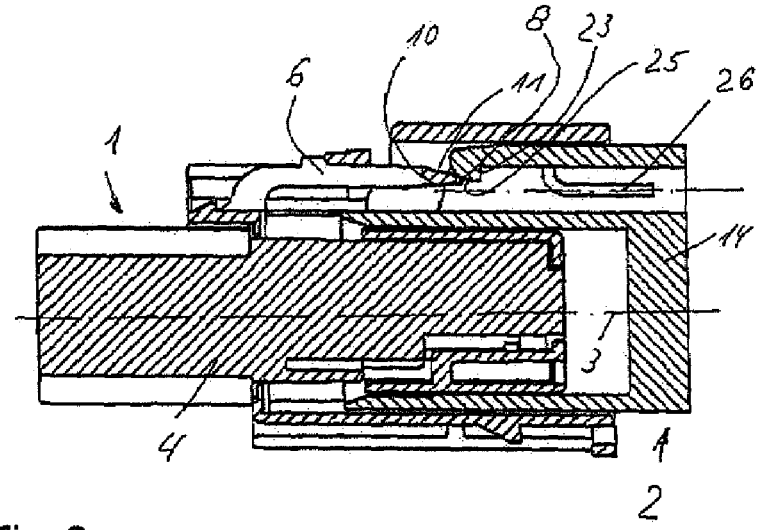
FIG. 2 shows the two connectors according to FIG. 1 in a position in which they have been moved closer to one another along the longitudinal axis, with the locking arm already resting against the ramp face of the second stop.
Figure 3:
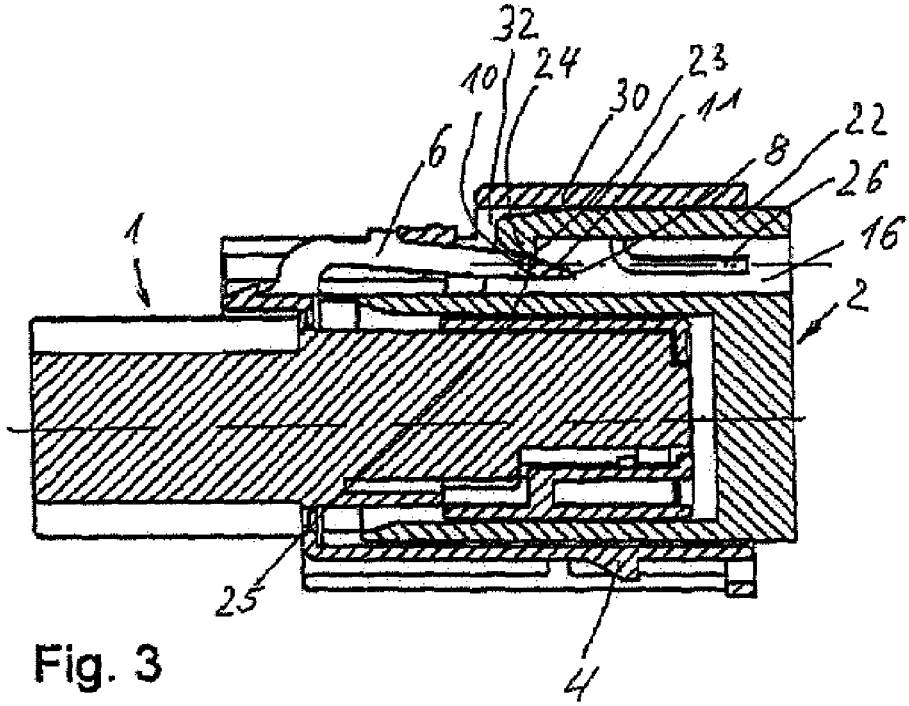
FIG. 3 shows the connecting process for the two connectors according to FIG. 1 on which they are in a more advanced position, with the locking arm being even further deflected.

In FIG. 1, the first connector 1 is shown to be aligned on the longitudinal axis 3, with the second connector 2 being aligned relative thereto on the longitudinal axis 3.

The first connector 1 is provided with a first housing 4 which comprises a first base portion 5 which is followed by a locking arm 6. The locking arm 6 comprises an end 7 which is connected to the base portion 5 from which it initially extends away from the longitudinal axis 3. Subsequently, the locking arm 6 extends substantially parallel to the longitudinal axis 3 and ends at the free end 8 which, as a result of elastic deformation, is freely movable on the longitudinal axis 3 towards same and away from same. FIG. 1 shows the untensioned position which is the starting position. Starting from said position, the elastic locking arm 6 can be elastically deformed. For example, under the influence of forces acting on its free end 8 or on an actuating portion, the locking arm 6 can be deflected towards the longitudinal axis 3. The locking arm 6 forms part of the first connector 1, i.e. more particularly of the first housing 4. The housing 4, in its entirety, is produced from an electrically insulating material, more particularly of plastics, with the material being selected to be such that the locking arm 6 comprises elastic properties, i.e. that if a force is applied to it, it is deflected out of the starting position shown in FIG. 1 and returned into same when said force is no longer applied.

Towards its free end 8, the locking arm 6 comprises a through-aperture 9 which forms a first stop 10, with the stop 10 being provided in the form of a surface which extends substantially at a right angle relative to the longitudinal axis 3. The locking arm 6 extends substantially parallel to the longitudinal axis 3, with the longitudinal axis 3 also constituting the axis along which the first connector 1 is connected to the second connector 2 and along which these are disconnected from one another.

Towards its free end 8, the locking arm 6 comprises an abutment face 11 which approaches the longitudinal axis from the connected end 8 to the free end 7.

The connector 2 which is also shown so as to be aligned on the longitudinal axis 3 comprises a second housing 14 which comprises a first tunnel portion 16 as well as a receiving chamber 13. The first connector 1 can be introduced with part of the first housing 4 into the receiving chamber 13 for the purpose of conductingly connecting the contact pins arranged therein to contact bushes in the first housing 4. The first tunnel portion 16 is delimited by two side walls, i.e. the first side wall 20 and the second side wall 21 which are formed on to the base portion 15 and extend away from the longitudinal axis 3, and by a ceiling portion 22 which is arranged at a distance from the second base portion 15 and which connects the two side walls 20, 21. The two side walls 20, 21 extend substantially parallel relative to the longitudinal axis 3 and relative to one another. The first tunnel portion 16 forms a tunnel axis 17 which extends parallel to the longitudinal axis 3. The first tunnel portion 16 comprises a first end 18 which faces the first connector 1 and a second end 19 which is removed from same. The first tunnel portion 16 is open at both ends. Towards the first end 18, the ceiling portion 22 is provided with a projection 24 which points towards the second base portion 15 which forms a second stop 23 in the form of a surface which extends approximately perpendicularly relative to the longitudinal axis 3. The projection 24 comprises a ramp face 25 which starts from the first end 18, which approaches the longitudinal axis 3 and ends at the second stop 23. Said projection 24 and the associated stop 23 as well as their cooperation with the locking arm 6 will be described in greater detail with reference to FIGS. 2 to 4.

In the first tunnel portion 16 there is provided at least one freely oscillatory tongue 26 which is offset from the first end 18 towards the second end 19, which is arranged at a distance from the projection 24 and which comprises an end 27 connected to the ceiling portion 22 of the first tunnel portion 16 and a second end 28 which is freely oscillatory towards the second end 19 of the first tunnel portion 16. The tongue 26 extends from its end 27 connected to the ceiling portion 22 initially towards the longitudinal axis 3 and then, at a distance from the ceiling portion 22, it extends approximately parallel to the tunnel axis 17 and to the longitudinal axis 3 towards the second end 19.

In addition, as illustrated in the above-referred to embodiment, the connector 1 can also be associated with a tunnel portion in the form of the second tunnel portion 30 which also extends parallel to the longitudinal axis 3 and follows the first base portion 5 of the first housing 4. It comprises side walls 32 which are connected to the first base portion 5 and a ceiling 31 connecting said side walls 32 with each other, wherein the ceiling 31 extends at a distance from the first base portion 13. Said second tunnel portion 30 is arranged in such a way that the free end 8 of the locking arm 6 is positioned in the second tunnel portion 30, i.e. the locking arm 6, by part of its length, projects into the second tunnel portion 30. The arrangement is such that an actuating portion 12 is positioned outside the second tunnel portion 30. Said actuating portion 12 serves to load the locking arm 6 manually in order to move same from the position shown in FIG. 1, i.e. the position assumed by the locking arm 6 when it is not loaded and also the position when the two connectors 1, 2 are accurately connected to one another with the first stop 10 and the second stop 23 locking the two connectors 1, 2 relative to one another. By loading the actuating portion 12, the first stop 10 associated with the locking arm 6 can be moved into a releasing position, so that the two connectors 1, 2 can be pulled apart against the connecting direction.

The second tunnel portion 30 also serves to prevent the locking arm 6 from being caught up in cables or other connectors during the transport of bundles of cable.

Figure 5:
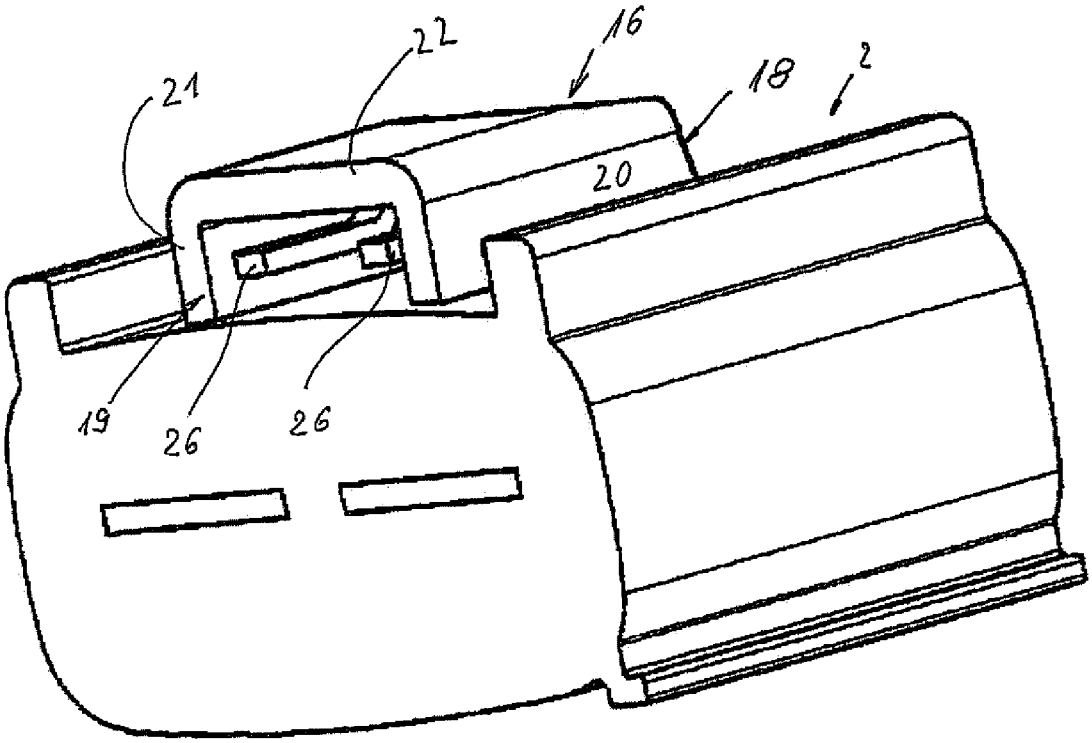
FIG. 5 shows a detail of the design of the first tunnel portion of the second connector as regards the arrangement of the freely oscillatory tongues.

It is possible to provide only one oscillatory tongue 26. However as is shown in greater detail in FIG. 5, it is preferable to provide two tongues 26 which are arranged parallel relative to one another and relative to the tunnel axis. To clarify the illustration, FIG. 5 shows the second connector 2 in a perspective view and rotated relative to FIG. 1, i.e. with a view of the side facing away from the first connector.

Figure 4:
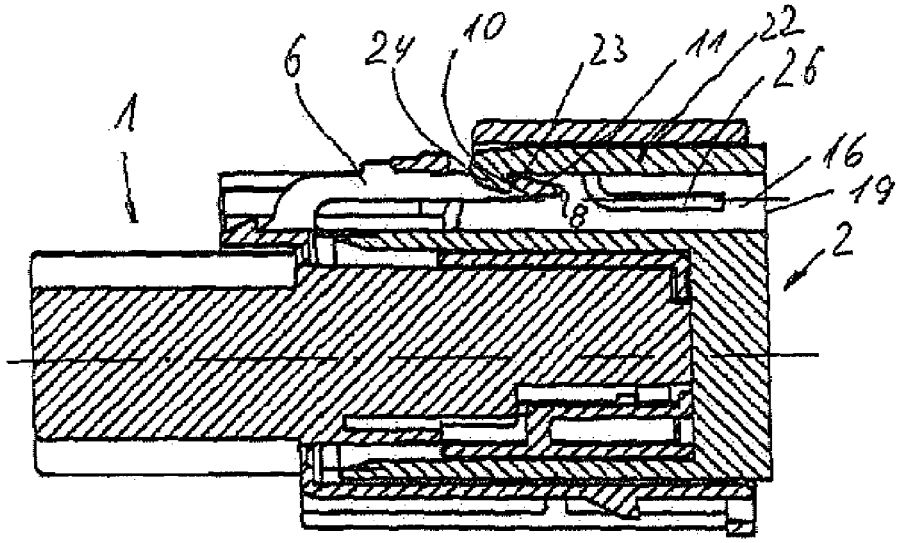
FIG. 4 shows the final connected condition along the longitudinal axis between the first connector and the second connector according to FIG. 1, with the locking arm being locked relative to the second stop of the second connector.

The two connectors 1, 2, starting from the position shown in FIG. 1, are made to approach one another along the longitudinal axis 3 on which they are aligned, with the locking arm 6 approaching the first tunnel portion 16 and entering same. Equally, part of the first housing 4 enters the receiving chamber 13 of the second housing 14. In the process, the locking arm 6, by means of its abutment face 11, contacts the ramp face 25 of the projection 14 and is loaded in such a way that, as the connecting process progresses, as illustrated in a further condition in FIG. 3 for example, the free end 8 is elastically deformed and converging the longitudinal axis 3, with the locking arm 6 being elastically pre-tensioned. Finally, the position being reached as shown in FIG. 4 wherein the first stop 10 has passed the second stop 23. The locking arm 6 has snapped back into its starting position as illustrated in FIG. 1, with the free end 8 of same distancing itself from the longitudinal axis 3. Thereby, the locking arm 6 preferably abuts the ceiling portion 22, so that the freely oscillating tongue 26 positioned in the first tunnel portion 16 is made to oscillate and generates an airborne sound which, more particularly, emerges from the second end 19 of the first tunnel portion 16 and indicates to the engineer in a way which is audible and can be sensed, that the final and accurate connected position between the first connector 1 and the second connector 2 has been reached.

The projection 24 can, alternatively, also be associated with the base portion.

Figure 7:
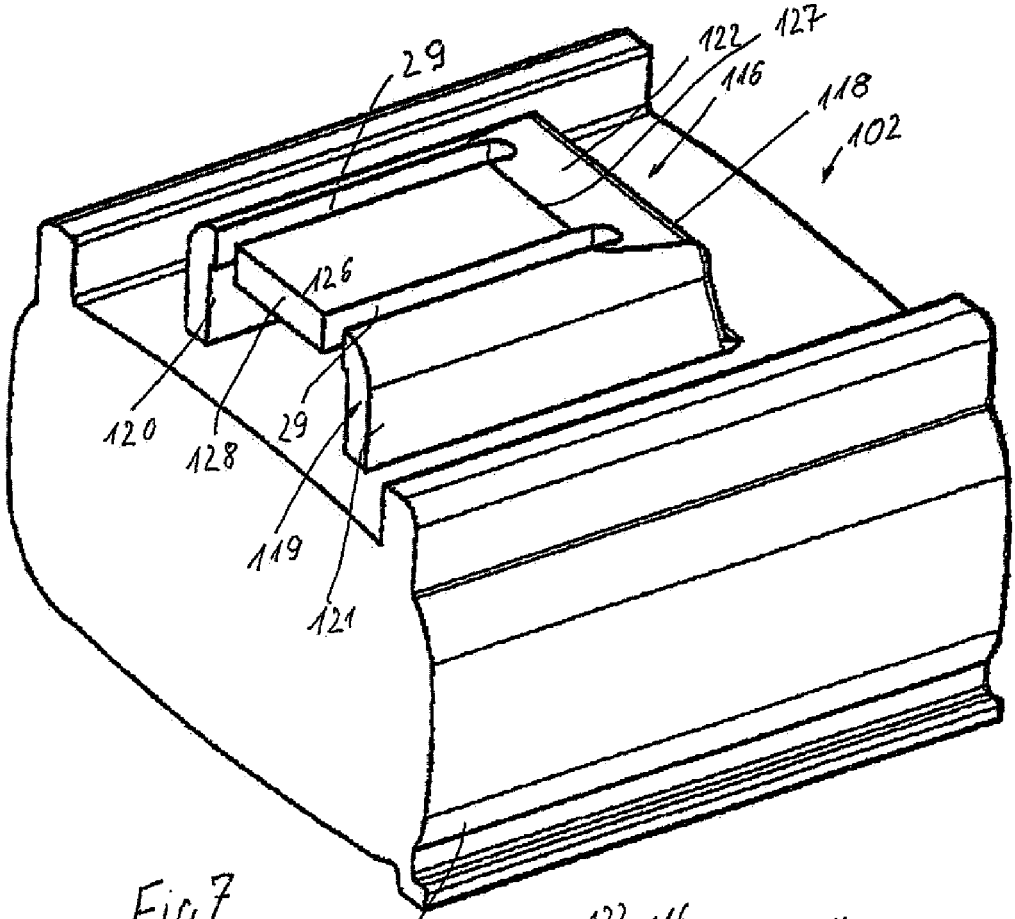
FIG. 7 is a further perspective view of the first tunnel portion with reference to the embodiment according to FIG. 6.
Figure 6:
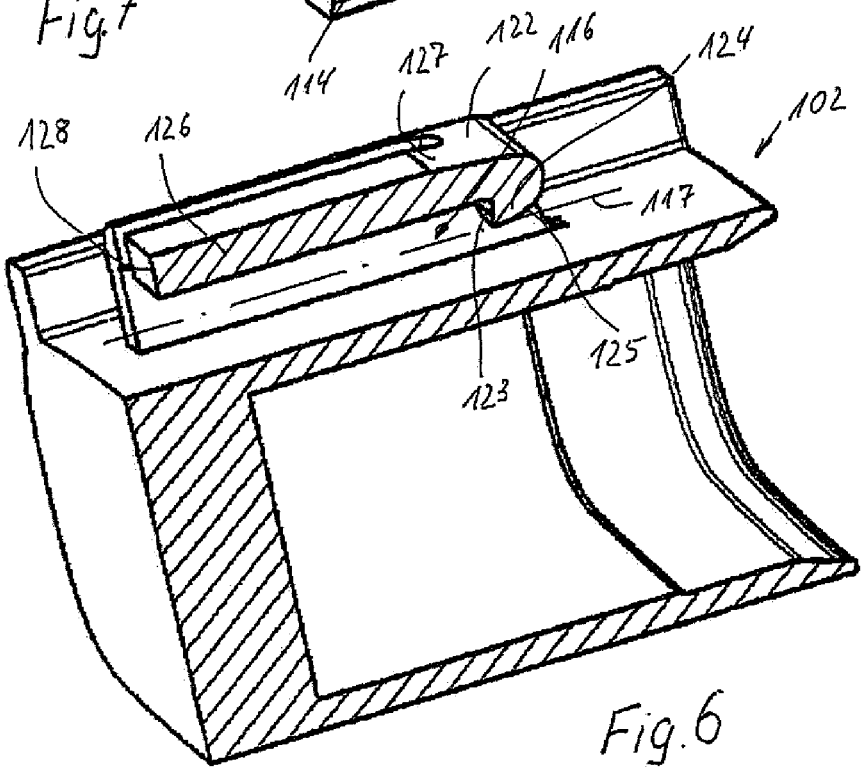
FIG. 6 shows a detail of a further design possibility for the freely oscillatory tongue as part of the ceiling portion of the tunnel portion, with the first tunnel portion being shown in a longitudinal section.
Figure 8:
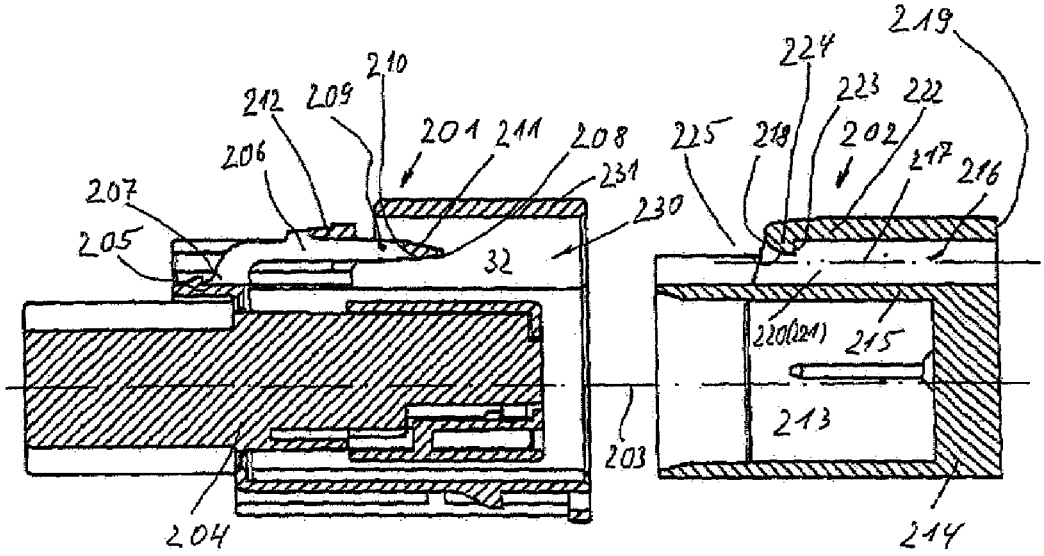
FIG. 8 shows a further embodiment of a connection assembly with a first connector and a second connector prior to being connected, wherein the first tunnel portion, more particularly the ceiling portion of same is designed to generate an airborne sound in cooperation with the locking arm of the first connector in a longitudinal section in an aligned condition relative to a common longitudinal axis prior to the two connectors being connected.
Figure 9:
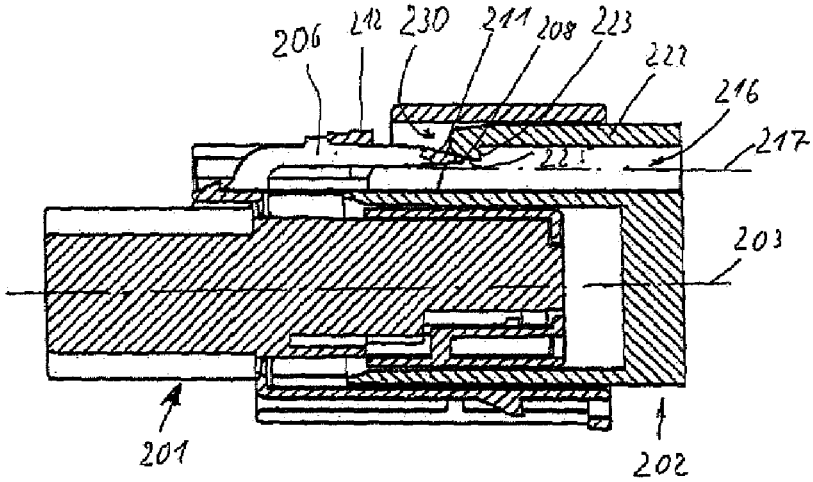
FIG. 9 shows the beginning of the process of connecting the two connectors according to FIG. 8, wherein the locking arm already touches the ramp face of the second stop of the second connector.

FIGS. 6 and 7 show a perspective plan view and a longitudinal section of a second connector 102 with a modified embodiment of a first tunnel portion 116. Said second connector 102 designed in this way can be connected to a first connector 1 as shown in FIG. 1.

The embodiment according to FIG. 6 differs from the embodiment according to FIGS. 1 to 5 in that the freely oscillatory tongue 126 forms part of the ceiling portion 122 of the first tunnel portion 116. The tongue 126 is formed in that the ceiling portion 122 is provided with two cuts 29 which start from the second end 119 of the first tunnel portion 116 and which extend approximately parallel to the longitudinal axis. However, towards the first end 118, the tongue 126 remains connected to the ceiling portion 122. In this region, inside the first tunnel portion 116, there is also positioned the projection 124 with the second stop 123 and the ramp face 125. For the rest, the embodiment of the second connector 102 corresponds to that of the second connector 2 according to FIGS. 1 to 5. In this embodiment, it is advantageous if there is provided a second tunnel portion 30 at the first connector 1, with the ceiling 31 of same being arranged at a distance from the freely oscillating tongue 126, so that there is obtained a sufficiently large sound chamber in which the tongue 126 is able to freely oscillate with its free end 128 to generate the required airborne sound which is necessary for generating a clearly audible sound.

FIGS. 8 to 11 show a further embodiment of a connection, with the connector 201 corresponding to the connector 1, so that, for the purpose of describing the connector 201, reference is made to the connector 1 being described with regard to FIGS. 1 to 5. In FIGS. 8 to 11, the connector 201 has been given positional reference numbers which have been increased by the figure 200 as compared to the respective components shown in FIGS. 1 to 5.

The second connector 202, too, is substantially similar to the connector 2 of FIGS. 1 to 5, so that, again, reference is made to the description of FIGS. 1 to 5. The only difference consists in that a freely oscillating tongue, as provided in FIGS. 1 to 5, has not been associated with the first tunnel portion 216. In the embodiment according to FIGS. 8 to 11, only the tunnel portion 216 itself, and therein more particularly in the form of the ceiling portion 222, is used for generating the airborne sound.

Figure 10:
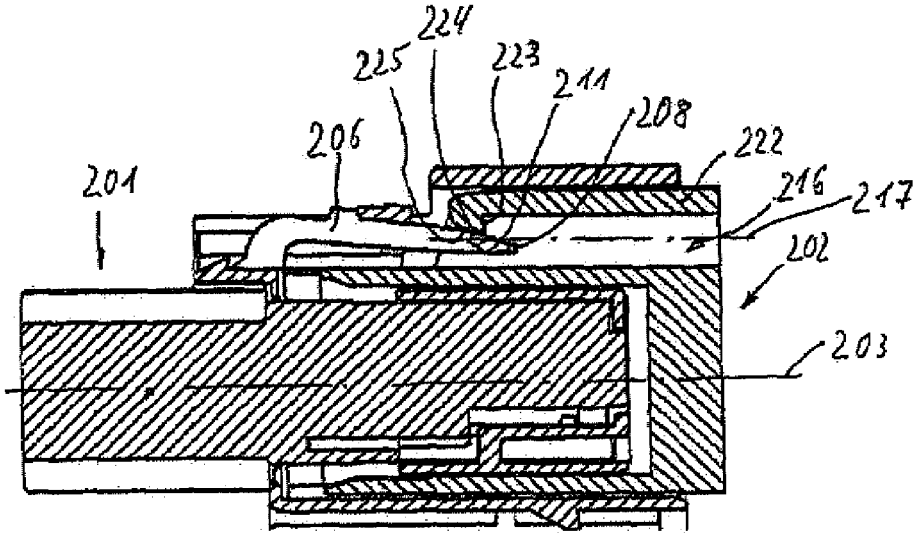
FIG. 10 shows a more advanced stage of the connecting process of the first connector and the second connector according to FIG. 8, with the locking arm already being elastically pre-tensioned by the projection formed by the second stop.
Figure 11:
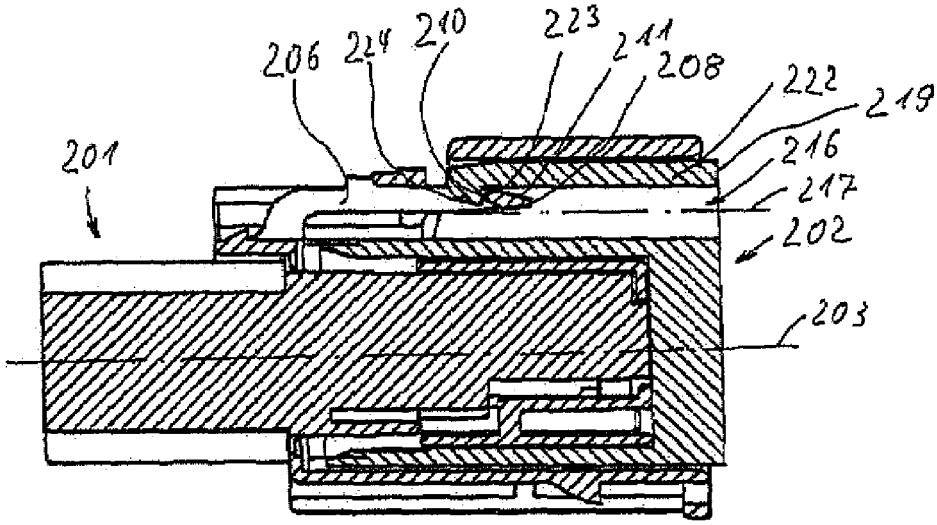
FIG. 11 shows the connected condition wherein the locking arm has snapped back and, in the process, abruptly loaded the first tunnel portion of the second connector.

The airborne sound is generated in that, when, as shown in FIG. 11, the locking arm 206 has reached its end position, and when its first stop 210 has passed the second stop 223 at the projection 224, the locking arm 206 snaps back elastically out of the deflected position, as illustrated in FIG. 10, and abuts the ceiling portion 222 which, if designed accordingly, can be made to oscillate, so that there is generated an airborne sound which emerges from the second end 219 and indicates clearly audibly to the engineer that the final connected position has been reached.

Otherwise, as far as the connecting process is concerned, reference is made to the description of FIGS. 1 to 5, but it has to be taken into account that in FIGS. 8 to 11, the positional reference numbers have been increased by 200 as compared to those given in FIGS. 1 to 5. As regards the description of the respective processes, reference is therefore made to the description of FIGS. 1 to 5.

What is claimed is:

1. A connection assembly having a first connector and a second connector which can be connected to or disconnected from one another by being adjusted along a longitudinal axis, wherein the first connector comprises a first housing which is provided with an elastically deformable locking arm comprising an end connected to the first housing and a free end, as well as a first stop;

the second connector comprises a second housing which is provided with a second stop;

the first stop and the second stop are designed in such a way that when the two connectors are being connected to one another, they cooperate in such a way that the elastic locking arm temporarily experiences an elastic deformation and, that, after the connected position has been achieved, it experiences an elastic return movement;

the second housing comprises a first tunnel portion with a tunnel axis, into which first tunnel portion the locking portion, in the connected condition of the two connectors, projects at least partially, which first tunnel portion, at least at one end, is open along the tunnel axis and in which there is arranged the second stop; and which first tunnel portion is associated with a freely oscillating tongue which comprises an end connected to the second housing and a oscillatory end, wherein the elastic return movement of the locking arm which is pre-tensioned when the first connector is being connected to the second connector, causes the tongue to oscillate, thus generating an airborne sound emerging from the first tunnel portion.

2. A connection assembly according to claim 1, wherein the tunnel portion is delimited by two side walls connected to a second base portion of the second housing and by a ceiling portion arranged opposite the second base portion and connecting the two side walls.

3. A connection assembly according to claim 1, wherein the first stop is formed by an opening in the locking arm and that the second stop is formed by a projection with a ramp face.

4. A connection assembly according to claim 1, wherein the second stop is associated with the ceiling portion of the tunnel portion.

5. A connection assembly according to claim 1, wherein the second stop is associated with the second base portion of the second housing.

6. A connection assembly according to claim 1, wherein the first tunnel portion and/or the tongue are/is designed in such a way that there is generated an airborne sound with a frequency of 1 kHz to 4 kHz.

7. A connection assembly according to any one of claim 1, wherein the first housing is associated with a second tunnel portion which, in the connected condition of the connectors, at least partially covers the first tunnel portion.

8. A connection assembly according to claim 2, wherein the at least one tongue is positioned between the ceiling portion and the second base portion.

9. A connection assembly according to claim 2, wherein the freely oscillating tongue, by means of its connected end, is attached to the ceiling portion and is positioned in the first tunnel portion.

10. A connection assembly according to claim 2, wherein the second stop is associated with the ceiling portion of the first tunnel portion and that the return movement of the locking arm generates an abrupt load on the ceiling portion.

11. A connection assembly according to claim 7, wherein the second tunnel portion, in the connected position of the connectors, encloses the first tunnel portion in such a way that a ceiling of the second tunnel portion is positioned at a distance from the first ceiling portion.

12. A connection assembly having a first connector and a second connector which can be connected to or disconnected from one another by being adjusted along a longitudinal axis, wherein the first connector comprises a first housing which is provided with an elastically deformable locking arm comprising an end connected to the first housing and a free end (208), as well as a first stop;

the second connector comprises a second housing which is provided with a second stop;

the first stop and the second stop are designed in such a way that when the two connectors are being connected to one another, they cooperate in such a way that the elastic locking arm temporarily experiences an elastic deformation and, that, after the connected position has been achieved, it experiences an elastic return movement;

the second housing comprises a first tunnel portion with a tunnel axis, into which first tunnel portion the locking arm, in the connected condition of the two connectors projects at least partially, which first tunnel portion, at least at one end, is open along the tunnel axis and which is delimited via two side walls connected to a second base portion of the second housing and via a ceiling portion which is arranged opposite the second base portion and connects the two side walls;

wherein the first stop in the first tunnel portion is arranged at the ceiling portion, and wherein the elastic return movement of the locking arm being pre-tensioned when the first connector is being connected to the second connector, causes the ceiling portion to oscillate due to an abrupt application of load, thus generating an airborne sound emerging from the first tunnel portion.

13. A connection assembly according to claim 2, wherein the tongue is formed by cuts in the ceiling portion.

14. A connection assembly according to claim 6, wherein there is generated an airborne sound with a frequency in the range of 2 kHz.

* * * * *